US008424815B2

(12) United States Patent
Dembowiak et al.

(10) Patent No.: US 8,424,815 B2
(45) Date of Patent: Apr. 23, 2013

(54) BAG SUPPORT

(75) Inventors: Casey M. Dembowiak, Greenfield, WI (US); Edmund A. Malczewski, Milwaukee, WI (US)

(73) Assignee: Riverwest Engineering & Design, Inc., West Allis, WI (US)

( * ) Notice: Subject to any disclaimer, the term of this patent is extended or adjusted under 35 U.S.C. 154(b) by 0 days.

(21) Appl. No.: 12/486,429

(22) Filed: Jun. 17, 2009

(65) Prior Publication Data

US 2010/0012794 A1 Jan. 21, 2010

Related U.S. Application Data

(63) Continuation of application No. 12/025,298, filed on Feb. 4, 2008, now Pat. No. 7,624,915, and a continuation of application No. 12/025,313, filed on Feb. 4, 2008, now abandoned.

(51) Int. Cl.
*A63B 55/04* (2006.01)

(52) U.S. Cl.
USPC ..... 248/99; 248/97; 248/101

(58) Field of Classification Search ..... 248/99, 248/95, 101, 97, 100; 141/390, 391
See application file for complete search history.

(56) References Cited

U.S. PATENT DOCUMENTS

| | | | | |
|---|---|---|---|---|
| 63,383 | A | | 4/1867 | Hanks |
| 100,123 | A | | 2/1870 | Crofoot |
| 102,616 | A | | 5/1870 | Sweigert |
| 447,686 | A | | 3/1891 | Holladay |
| 653,035 | A | | 7/1900 | Noble |
| 1,022,862 | A | | 4/1912 | McMillen |
| 2,113,153 | A | * | 4/1938 | Jonassen ..... 248/101 |
| 2,125,122 | A | | 7/1938 | Luigi |
| 2,421,221 | A | | 5/1947 | Rothe |
| 2,470,977 | A | | 5/1949 | Chidsey, Jr. |
| 3,204,866 | A | | 9/1965 | Brighton et al. |
| 3,314,632 | A | | 4/1967 | Freuler |
| 3,451,582 | A | | 6/1969 | Morgan |
| 3,502,291 | A | | 3/1970 | Ackerman et al. |
| 3,556,396 | A | | 1/1971 | Herman |
| 3,659,816 | A | | 5/1972 | Wilson |
| 3,866,824 | A | | 2/1975 | Lewis |
| 3,948,474 | A | | 4/1976 | Pomroy |
| 4,199,122 | A | | 4/1980 | Christie |
| 4,363,438 | A | | 12/1982 | Connor |
| 4,537,376 | A | * | 8/1985 | Buku ..... 248/97 |
| 4,577,778 | A | | 3/1986 | Kim |
| 4,593,873 | A | | 6/1986 | Nelson |
| 4,613,104 | A | | 9/1986 | Garrott |
| 4,697,771 | A | | 10/1987 | Majors |
| 4,711,367 | A | | 12/1987 | Albertson |
| 4,723,741 | A | | 2/1988 | Doering |
| 4,793,628 | A | | 12/1988 | Haley, Sr. |
| D304,873 | S | | 11/1989 | Ruehland |

(Continued)

*Primary Examiner* — Anita M King
(74) *Attorney, Agent, or Firm* — Bogle Fredickson, S.C.

(57) ABSTRACT

A bag support is provided for supporting a pliable bag. The bag support includes a first bar extending along a first axis and a second bar extending along a second axis generally parallel to the first axis. A first support has a first end operatively connected to the first bar and a second end operatively connected to the second bar. A first bag retainer extends from the first bar. The first bag retainer has first and second ends. A second bag retainer extends from the second bar. The second bag retainer has first and second ends.

18 Claims, 15 Drawing Sheets

U.S. PATENT DOCUMENTS

| | | | | | |
|---|---|---|---|---|---|
| 4,953,815 | A | | 9/1990 | Beymer et al. | |
| 4,979,705 | A | * | 12/1990 | Bovitz | 248/97 |
| 5,044,644 | A | | 9/1991 | Duran et al. | |
| 5,076,458 | A | | 12/1991 | Weiner et al. | |
| 5,203,618 | A | | 4/1993 | Oshall | |
| D337,402 | S | | 7/1993 | Burelle | |
| D352,581 | S | | 11/1994 | Fredericks | |
| 5,360,189 | A | | 11/1994 | Hart | |
| 5,380,081 | A | * | 1/1995 | Vogt | 312/212 |
| 5,390,813 | A | | 2/1995 | Anderson et al. | |
| 5,398,838 | A | | 3/1995 | Dosunmu | |
| D358,012 | S | | 5/1995 | Faulkner et al. | |
| 5,411,229 | A | | 5/1995 | Hoefkes | |
| 5,570,862 | A | | 11/1996 | Nugent | |
| D388,922 | S | | 1/1998 | Peters | |
| 5,799,908 | A | | 9/1998 | Downs | |
| 5,819,974 | A | | 10/1998 | Caldwell | |
| 5,887,696 | A | | 3/1999 | Goetz | |
| D423,168 | S | | 4/2000 | Studstill | |
| 6,076,782 | A | | 6/2000 | Alderman | |
| D428,229 | S | | 7/2000 | Olivetti | |
| 6,116,549 | A | | 9/2000 | Santa Cruz et al. | |
| 6,241,115 | B1 | | 6/2001 | Delmerico et al. | |
| 6,334,593 | B2 | | 1/2002 | Inoue | |
| 6,491,264 | B1 | | 12/2002 | Valesquez | |
| 6,550,792 | B1 | | 4/2003 | Salmon et al. | |
| D481,509 | S | | 10/2003 | Perelli | |
| 6,676,141 | B1 | | 1/2004 | Hadley | |
| D507,089 | S | | 7/2005 | Enayati et al. | |
| 7,032,868 | B2 | | 4/2006 | Mutert | |
| D521,204 | S | | 5/2006 | Lauer | |
| D531,373 | S | | 10/2006 | DesLaurier | |
| 7,188,745 | B2 | | 3/2007 | Schermel | |
| D546,521 | S | | 7/2007 | Mutert | |
| D552,320 | S | | 10/2007 | Presnell et al. | |
| 7,624,915 | B2 | * | 12/2009 | Dembowiak et al. | 232/43.2 |
| 2006/0196879 | A1 | | 9/2006 | Chochinov et al. | |

* cited by examiner

BAG SUPPORT

CROSS-REFERENCE TO RELATED APPLICATIONS

This application is a continuation of application Ser. No. 12/025,298 filed Feb. 4, 2008, now U.S. Pat. No. 7,624,915 and application Ser. No. 12/025,313 filed Feb. 4, 2008 now abandoned.

FIELD OF THE INVENTION

This invention relates generally to recycling centers, and in particular, to a bag support for supporting a conventional plastic bag in an open position.

BACKGROUND AND SUMMARY OF THE INVENTION

As is known, the United States produces over 250 million tons of municipal solid waste each year. This number represents approximately 4.6 pounds of waste per person per day. A large portion of this waste is hauled away in garbage trucks and packed into sanitary landfills. As a result, landfilling has become the number disposing trash in the United States. However, most of the material disposed of in landfills is recyclable. Hence, in order to reduce the volume of waste disposed of in landfills, Americans have turned to recycling. It has be found that recycling benefits the environment at every stage in the life cycle of a consumer product, from the raw material used to make the product, to the final method of disposal. In order to encourage recycling, many public facilities have start to position recycling bins throughout their premises.

Typically, a recycling bin is defined by a housing having a plurality of openings or slots that provide access to the interior of the housing. A pliable bag is positioned within the interior of the housing to receive any recyclable material deposited in the openings or slots thereof. It can be appreciated that various types of bag holders have been developed to maintain the openings in the pliable bags in desired positions within the housings. By way of example, Mutert, U.S. Pat. No. 7,032,868 discloses a bag stand for supporting a bag during filling of the bag. More specifically, the bag stand includes first and second legs pivotable with respect to one another about a pivot axis. The first and second legs pivot between a first position wherein the first and second legs are substantially aligned with respected to each other for storage and a second position wherein the first and second legs are transverse with respect to each other in order to receive a bag. The upper portions of the first and second legs of the bag stand include excurvate portions adapted for receiving the upper edge of a bag and for a bag support receivable within the interior of a modular recycling center for supporting a conventional plastic bag in an open position.

While functional for their intended purpose, these prior bag supports have certain shortcomings. By way of example, the bag support disclosed in the '868 patent requires the upper edge of the bag to be weaved through various bends in the first and second legs in order to maintain the bag in position. It can be appreciated that it is often difficult for a user to properly interconnect the upper edge of the bag to the excurvate portions of the first and second legs. Hence, it is highly possible for the pliable bag to be disengaged from the bag stand during filling. If the pliable bag becomes disengaged from the bag stand, any recyclable material deposited in the openings or slots in the housing of the recycle bin may fall outside of the bag, thereby causing a mess within housing.

Therefore, it is a primary object and feature of the present invention to provide a bag support receivable within the interior of a modular recycling center for supporting a conventional plastic bag in an open position during the filling of the bag.

It is a further object and feature of the present invention to provide a bag support receivable within the interior of a modular recycling center for supporting a conventional plastic bag in an open position that is simple to utilize and inexpensive to manufacture.

It is a still further object and feature of the present invention to provide a bag support that may be easily inserted into the interior of a modular recycling center.

In accordance with the present invention, a bag support is provided for supporting the upper portion of a bag. The bag support includes first and second side rails generally parallel to each other. A first bag support rod extends between the first and second rails along a first axis. The first bag support rod includes a first bag retainer extending therefrom. A second bag support rod extends between the first and second rails along a second axis generally parallel to the first axis. The second bag support rod includes a first bag retainer extending therefrom.

The first bag retainer extending from the first bag support rod may be one of a plurality of bag retainers extending from the first bag support rod. The plurality of bag retainers extending from the first bag support rod lie in a common plane. Similarly, the first bag retainer extending from the second bag support rod may be one of a plurality of bag retainers extending from the second bag support rod. The plurality of bag retainers extending from the second bag support rod lie in a common plane.

The first bag retainer extending from the first bag support rod has first and second ends. The first end of the first bag retainer extending from the first bag support rod is generally C-shaped and the second end of the first bag retainer extending from the first bag support rod is generally C-shaped. The first bag retainer extending from the second bag support rod has first and second ends. The first end of the first bag retainer extending from the second bag support rod is generally C-shaped and the second end of the first bag retainer extending from the second bag support rod is generally C-shaped.

The first and second rails include forward and rear ends. The first bag support rod extends between the rear ends of the first and second rails. The second bag support bar extends between the forward ends of the first and second rails.

In accordance with a further aspect of the present invention, a bag support is provided. The bag support includes a first bar extending along a first axis. The first bar has a first bag retainer extending therefrom. The first bag retainer supports an upper portion of a corresponding bag. A second bar extends along a second axis generally parallel to the first axis. The second bar has a first bag retainer extending therefrom. The first bag retainer of the second bar supports the upper portion of the corresponding bag. A first support member extends along a third axis. The first support member has a first end operatively connected to the first bar and a second end operatively connected to the second bar.

The first bag retainer extends from the first bar is one of a plurality of bag retainers extending from the first bar. The plurality of bag retainers extending from the first bar lie in a common plane. The first bag retainer extending from the second bar is one of a plurality of bag retainers extending from the second bar. The plurality of bag retainers extending from the second bar lie in a common plane.

The first bag retainer extending from the first bar has first and second ends. The first end of the first bag retainer extending from the first bar is generally C-shaped and the second end of the first bag retainer extending from the first bar is generally C-shaped. The first bag retainer extending from the second bar has first and second ends. The first end of the first bag retainer extending from the second bar is generally C-shaped and the second end of the first bag retainer extending from the second bar is generally C-shaped.

In accordance with a still further aspect of the present invention, a bag support is provided. The bag support includes a first bar extending along a first axis. A second bar extends along a second axis generally parallel to the first axis. A first support has a first end operatively connected to the first bar and a second end operatively connected to the second bar. A first bag retainer extends from the first bar. The first bag retainer has first and second ends. A second bag retainer extends from the second bar. The second bag retainer has first and second ends.

The first end of the first bag retainer is generally C-shaped and the second end of the first retainer is generally C-shaped. The first end of the second bag retainer is generally C-shaped and the second end of the second bag retainer is generally C-shaped. The first bag retainer extending from the first bar is one of a plurality of bag retainers extending from the first bar. The second bag retainer extending from the second bar is one of a plurality of bag retainers extending from the second bar.

BRIEF DESCRIPTION OF THE DRAWINGS

The drawings furnished herewith illustrate a preferred construction of the present invention in which the above advantages and features are clearly disclosed as well as other which will be readily understood from the following description of the illustrated embodiment.

In the drawings.

DETAILED DESCRIPTION OF THE DRAWINGS

Figure 1:
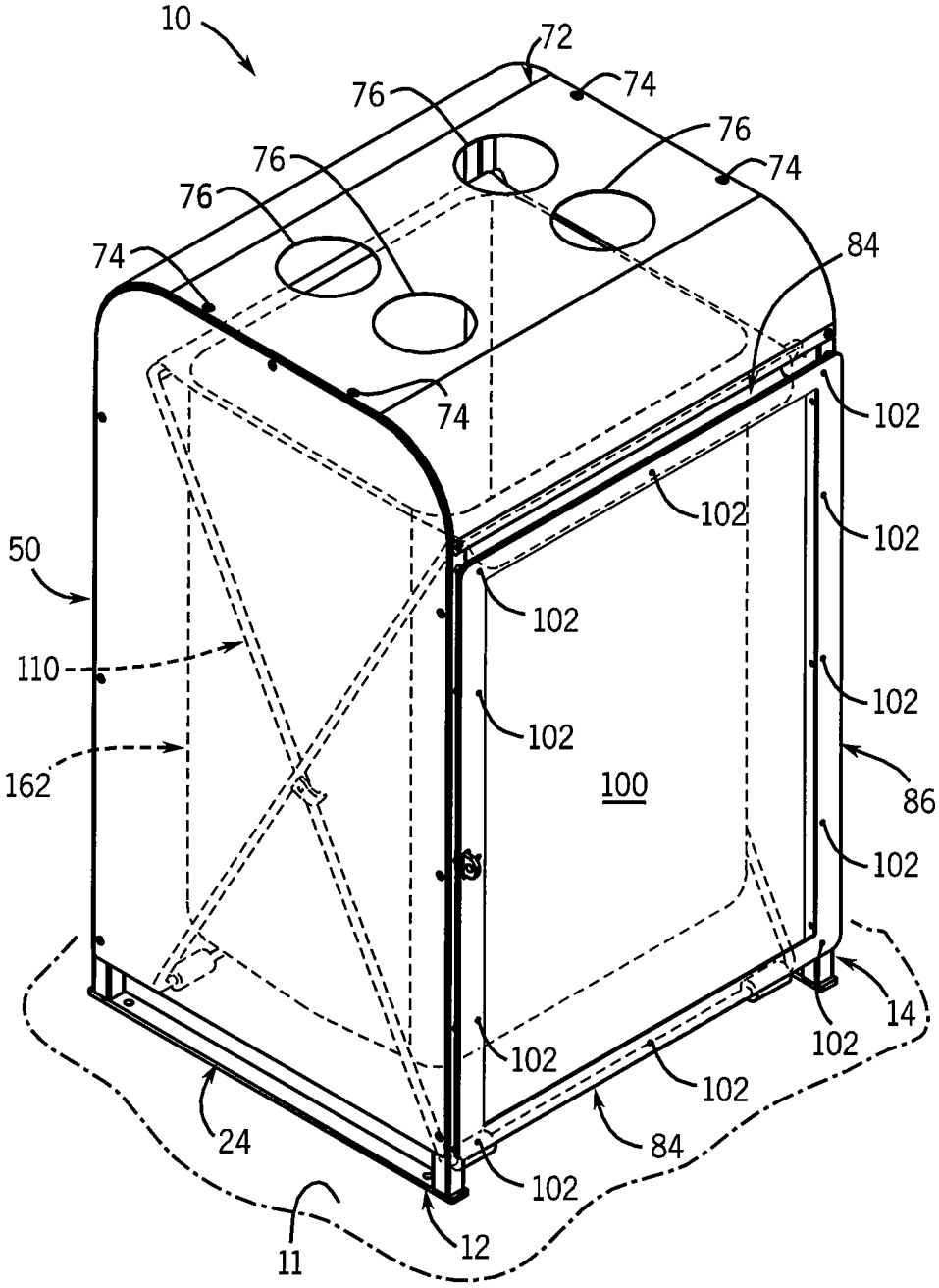
FIG. 1 is an isometric view of a recycling center incorporating a bag support in accordance with the present invention.

A recycling center for receiving a bag support in accordance with the present invention is generally designated by the reference numeral 10. As hereinafter described, it is intended for the recycle center 10 to be supported on a supporting surface 11 and to house a bag or the like for receiving recyclable materials therein. Recycle center 10 includes first and second generally U-shaped frame members 12 and 14, respectfully. It is noted that first and second frame members 12 and 14 are identical in structure. As such, the description hereinafter of first frame member 12 is understood to describe second frame member 14 as if fully described herein.

First frame member 12 is generally U-shaped and has a generally square cross section. As best seen in FIGS. 1B and 1C, first frame member 12 is defined by first and second spaced legs 16 and 18, respectfully. Upper ends of first and second legs 16 and 18, respectfully, of first frame member 12 are interconnected by upper cross leg 20. First and second legs 16 and 18 terminate at generally flat lower ends 16*a* and 18*a*, respectfully. Lower ends 16*a* and 18*a* of first and second legs 16 and 18, respectfully, of first frame member 12 are positioned on and interconnected to upper surface 22 of generally flat lower frame member 24.

First leg 16 of first frame member 12 includes a generally parallel inner and outer faces 26 and 28, respectively, interconnected by generally parallel sides 30 and 32, respectfully. Second leg 18 of first frame member 12 also includes inner and outer faces 34 and 36, respectively. Outer face 36 of second leg 18 of first frame member 12 lies in a common plane with outer face 28 of first leg 16 of first frame member 12. Inner and outer faces 34 and 36, respectively, of second leg 18 of first frame member 12 are interconnected by first and second generally parallel, spaced sides 38 and 40, respectively. Sides 30 and 40 of first and second legs 16 and 18, respectively, of first frame member 12 are interconnected by upper surface 42 of upper cross leg 20. Outer faces 28 and 36 of first and second legs 16 and 18, respectively, of first frame member 12 are interconnected by generally flat outer face 44 of cross leg 20.

First and second frame members 12 and 14, respectively, are interconnected by forward cross frame support 46. Forward cross frame support 46 includes a first end 46*a* affixed to side 40 of second leg 18 of first frame member 12 and a second end 46*b* affixed to side 40 of second leg 18 of second frame member 14. It is further contemplated to interconnect first legs 16 of first and second frame members 12 and 14, respectively, to add strength and rigidity to recycle center 10.

First panel 50 is interconnected to outer faces 28 and 36 of first and second legs 16 and 18, respectively, of first frame member 12 and to outer face 44 of upper cross leg 20 of first frame member 12. First panel 50 includes a first edge 52 aligned with side 30 of first leg 16 of first frame member 12; a second edge 54 aligned with side 40 of second leg 18 of first frame member 12; and upper edge 56 aligned with upper face 42 of upper cross leg 20 of first frame member 12. It is contemplated to interconnect first panel 50 to first frame member 20 with a plurality of spaced fasteners 58 such as rivets, screws, bolts or the like. It is further contemplated to provide indicia 16 on outer surface 62 of first panel 50 so as to allow a user to identify recycle center 10, as desired.

Second panel 64 is attached to outer faces 28 and 36 of first and second legs 16 and 18, respectively, of second frame member 14 and to outer face 44 of upper cross leg 20 of second frame member 18 by a plurality of spaced fasteners 58. Edge 66 of second panel 64 is aligned with outer face 30 of first leg 16 of second frame member 18; edge 68 of panel 64 is aligned with side 40 of second leg 18 of second frame member 14; and the upper edge of panel 64 is aligned with upper face 42 of upper cross leg 20 of second frame member 14. Outer surface 70 of second panel 64 may include indicia (not shown) to allow a user to identify recycle center 10, as desired.

Recycle center 10 may also include an optional rear panel (not shown) interconnected to first legs 16 of first and second frame members 12 and 14, respectively. In addition, recycle center 10 includes an upper panel 72 positioned on and interconnected to upper faces 42 of upper cross legs 20 of first and second frame members 12 and 14, respectively, by a plurality of fasteners 74 such as screws, bolts, and/or rivets. A plurality of apertures 76 extend through upper panel 72, for reasons hereinafter described. With upper panel 72 positioned on first and second frame members 12 and 14, respectively, forward edge 78 of upper panel 76 is adjacent upper edge 80 of forward cross support 46. As hereinafter described, upper panel 72 and first and second side panels 50 and 64, respectively, define a chamber for receiving a conventional bag 162 therein.

Figure 1B:
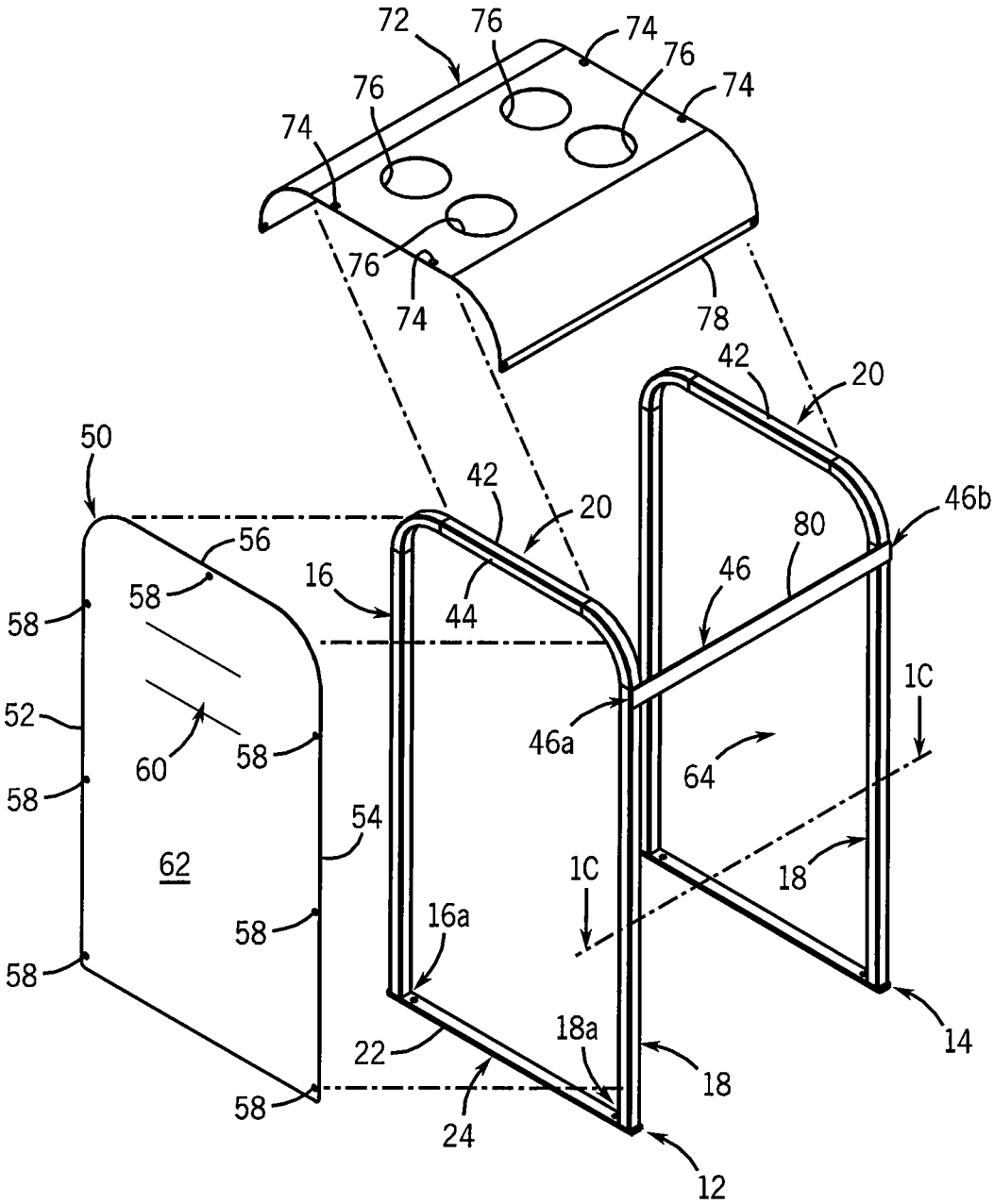
FIG. 1B is an exploded view of a portion of the recycling center of FIG. 1.
Figure 1C:
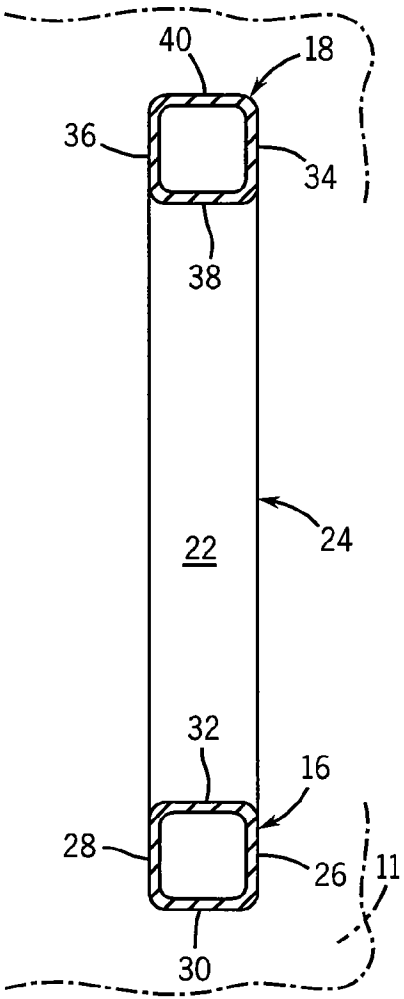
FIG. 1C is a cross-sectional view of the recycling center of the present invention taken along line 1C-1C of FIG. 1B.
Figure 1C:
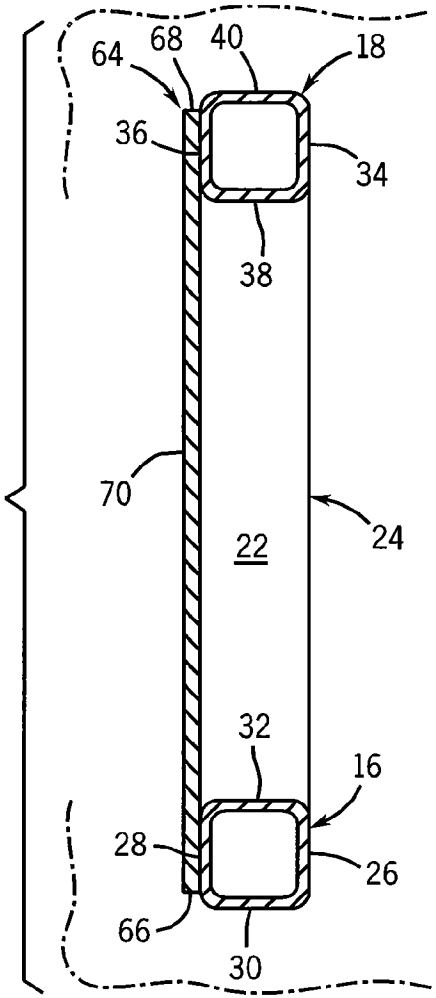
Figure 2:
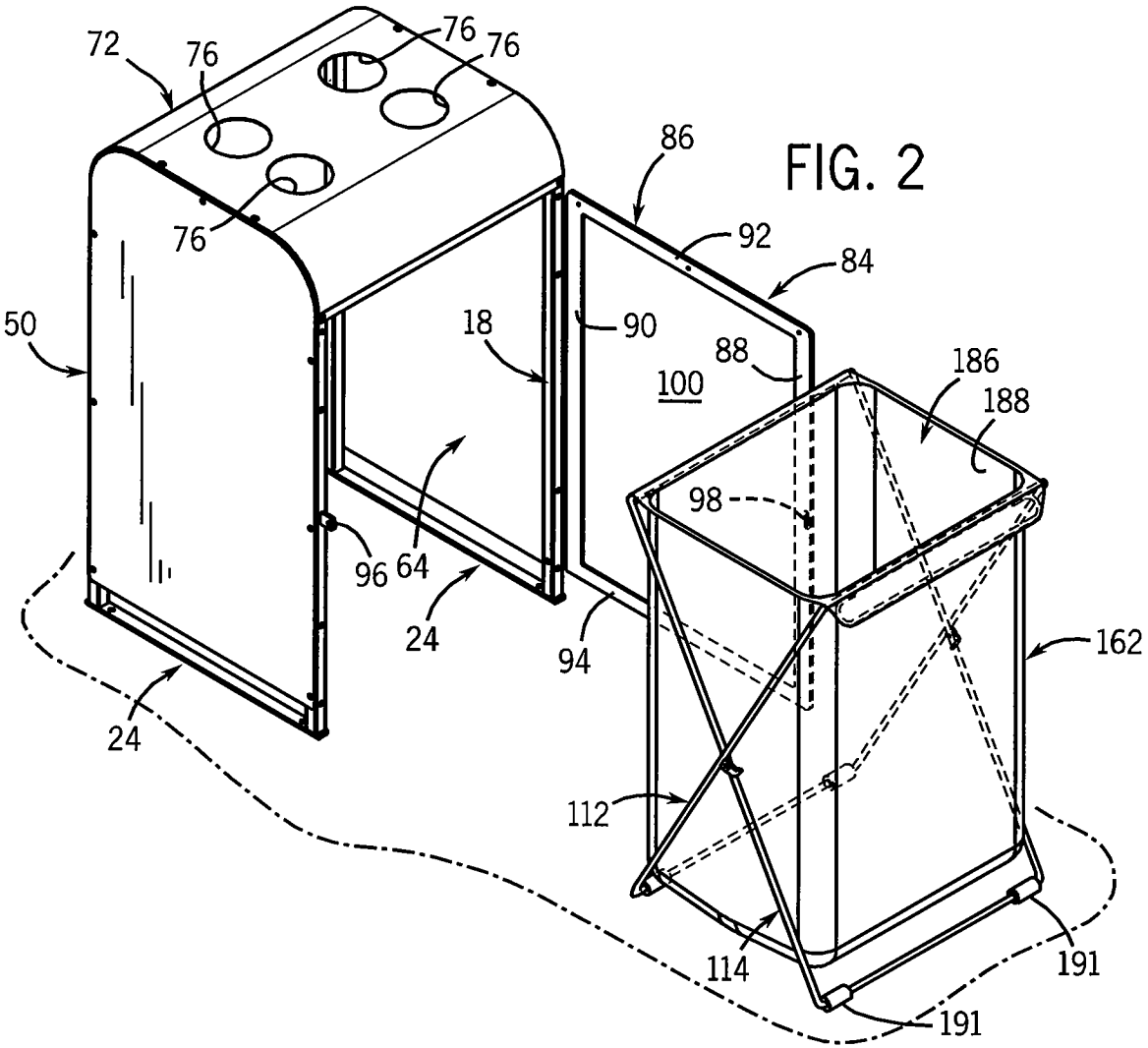
FIG. 2 is an isometric view of the recycling center of the present invention with the door of the recycling center in an open position.

As best seen in FIGS. 1 and 2, Recycle center 10 further includes door 84 to provide access to the chamber therein. Door 84 includes a generally rectangular frame 86 having first and second side elements 88 and 90, respectively, interconnected by upper and lower frame elements 92 and 94, respectively. Side frame element 90 of frame 86 is interconnected to side 90 of second leg 18 of second frame member 14 by one or more hinges so as to allow door 84 to pivot between a closed position, FIG. 1, and an open position, FIG. 2. In order to maintain door 84 in a closed position, locking eye 96 may project from side 40 of second leg 18 of first frame element 12. Locking eye 96 is aligned with a corresponding slot 98 in side frame element 88 of frame 86 of door 84 such that with door 84 in the closed position, locking eye 96 projects through slot 98 in frame 86 of door 84. A locking bar of a conventional pad lock may be inserted through the eye of locking eye 96 to retain door 84 in its closed position. Panel 100 may be positioned within the opening defined by frame 86 and interconnected to frame 86 and retained therein by a plurality of fasteners 102. It is intended for panel 100 to be transparent in order to allow the quick and easy inspection of the chamber defined by the interior of recycle center 10.

Referring to FIGS. 3-8, a bag support in accordance with the present invention is generally designated by the reference numeral 110. Bag support 110 includes first and second generally rectangular wire frames 112 and 114, respectively. As hereinafter described, second wire frame 114 is pivotably connected to first wire frame 112 and passes through the interior thereof. First wire frame 112 is defined by first and second side frame members 116 and 118, respectively, interconnected by upper and lower frame members 120 and 122, respectively. First and second side frame members 116 and 118, respectively, are generally parallel to each other. Upper and lower frame members 120 and 122, respectively, are generally parallel to each other and perpendicular to first and second side frame members 116 and 118, respectively.

Second wire frame 114 is defined by first and second side frame members 124 and 126, respectively, interconnected by upper and lower frame members 128 and 130, respectively. First and second side frame members 124 and 126, respectively, are generally parallel to each other. Upper and lower frame members 128 and 130, respectively, are generally parallel to each other and perpendicular to first and second side frame members 124 and 126, respectively.

First and second generally rectangular wire frames 112 and 114, respectively, are pivotably connected by first and second pivots 132 and 134, respectively. First pivot 132 is defined by base 136 having outer periphery 138. First side 139 of outer periphery 138 of base 136 is generally flat and bonded to first side frame member 116 such that base 136 extends from first side frame member 116 in a first direction. Stop 140 projects from second, opposite side 142 of base 136. Stop 140 includes an arm portion 144 extending along an axis generally perpendicular to the first direction toward second side frame member 118 of first wire frame 112. Pivot pin 146 extend through base 136 of first pivot 132 and into first side frame member 124 of second wire frame 114 so as to pivotably connect first side frame member 124 of second wire frame 114 to first pivot 132, and hence, to first side frame member 116 of first wire frame 112.

Second pivot 134 is defined by base 148 having outer periphery 150. First side 152 of outer periphery 150 of base 148 is generally flat and bonded to second side frame member 118 such that base 148 extends from second side frame member 118 in the first direction. Stop 154 projects from second, opposite side 156 of base 148. Stop 154 includes an arm portion 158 extending along an axis generally perpendicular to the first direction toward first side frame member 116 of first wire frame 112. It is intended for the arm portions 144 and 158 of first and second pivots 132 and 134, respectively, to lie on a common axis. Pivot pin 160 extends through base 148 of second pivot 134 and into second side frame member 126 of second wire frame 114 so as to pivotably connect second side frame member 126 of second wire frame 114 to second pivot 134, and hence, to second side frame member 118 of first wire frame 112. It is intended for pivot pins 146 and 160 to lie on a common pivot axis.

Figure 3:
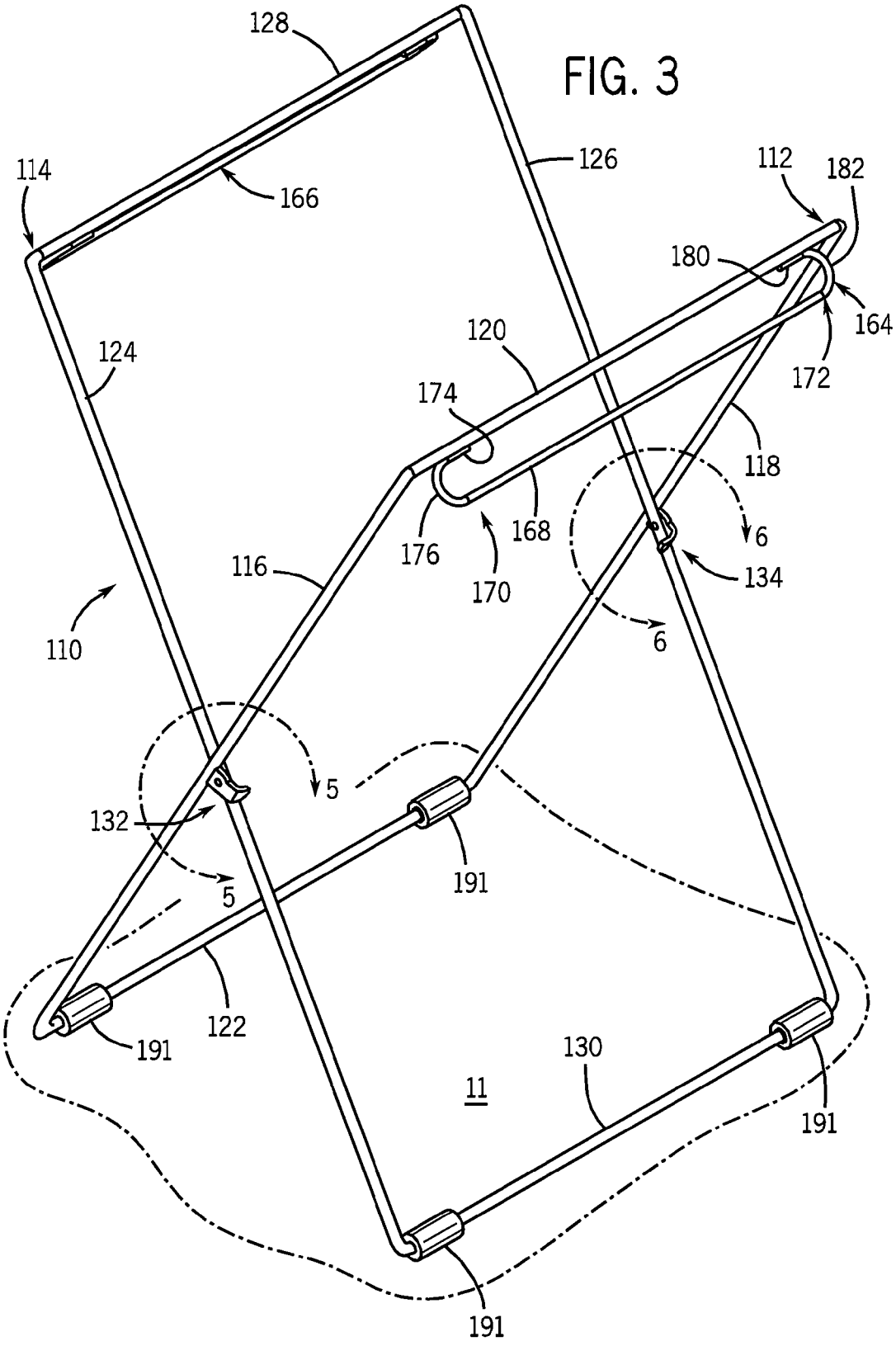
FIG. 3 is an isometric view of the bag support the present invention.
Figure 4:
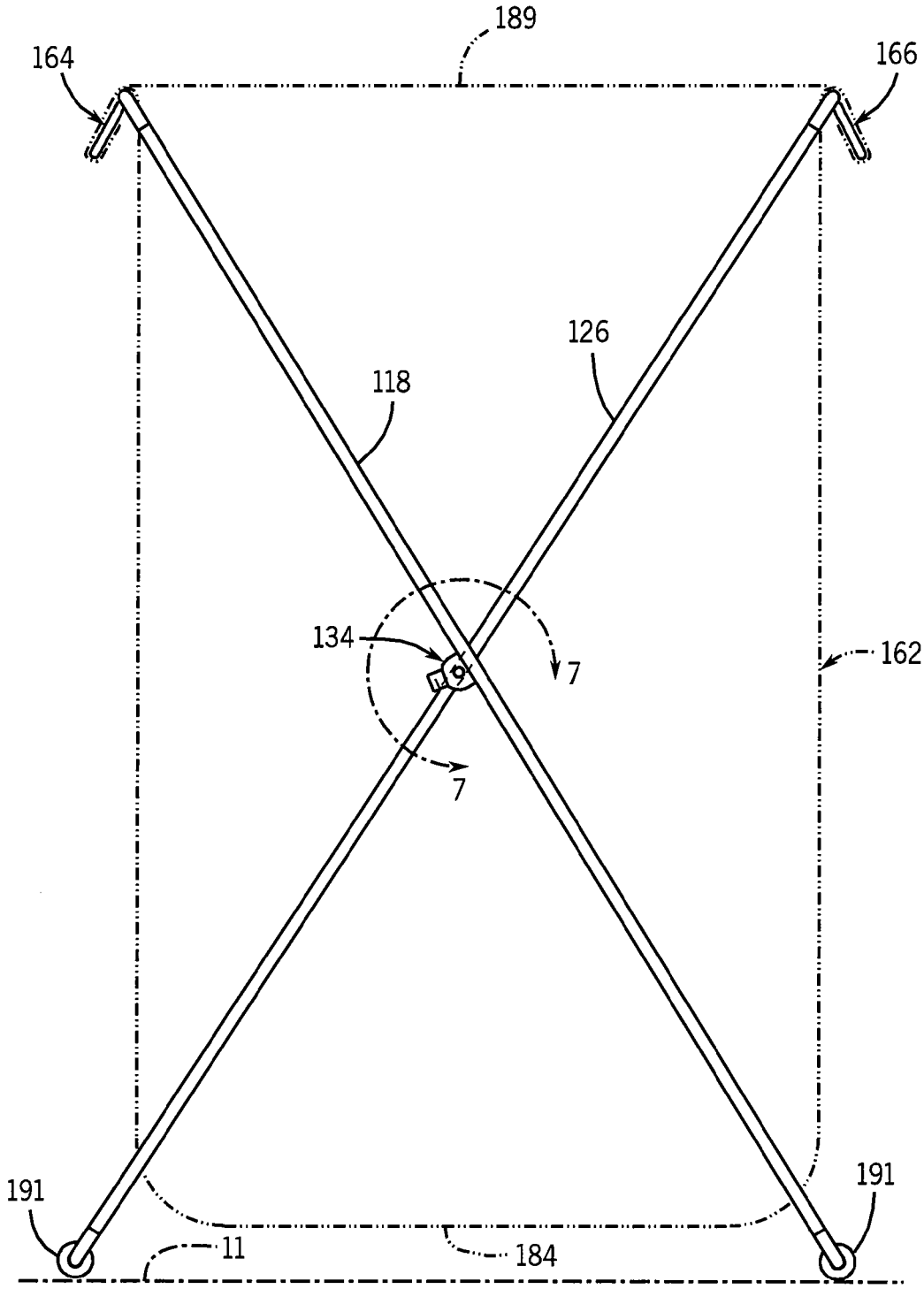
FIG. 4 is a side elevational view of the bag support of FIG. 3.
Figure 5:
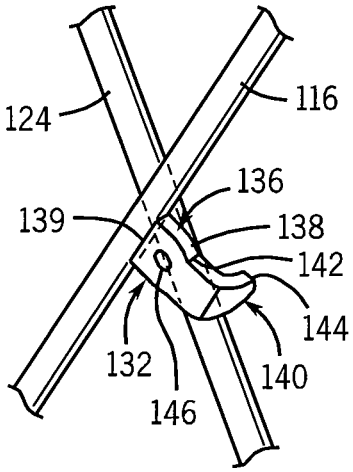
FIG. 5 is a cross-sectional view of the bag support of the present invention taken along line 5-5 of FIG. 3.
Figure 6:
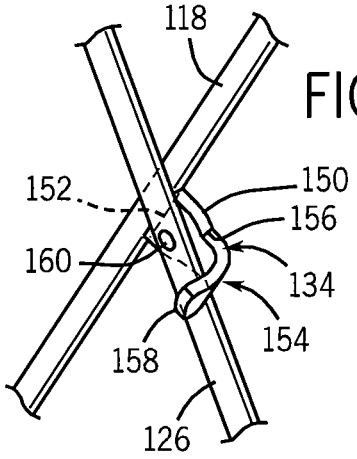
FIG. 6 is a cross-sectional view of the bag support of the present invention taken along line 6-6 of FIG. 3.
Figure 8:
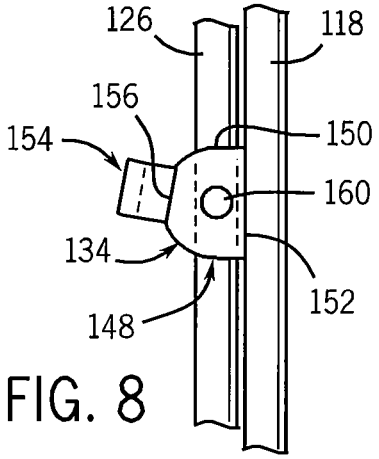
FIG. 8 is a cross-sectional view of the bag support of the present invention, similar to FIG. 7, with the bag support in a folded configuration.
Figure 7:
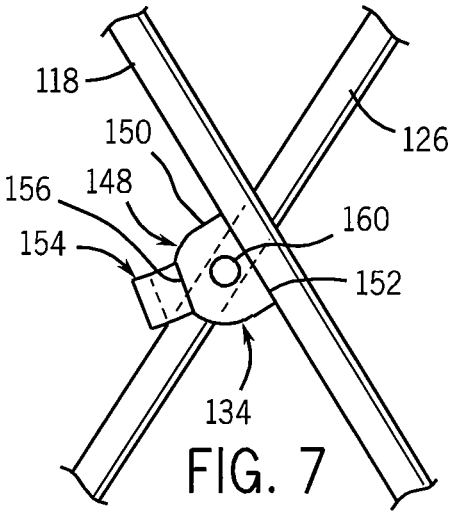
FIG. 7 is a cross-sectional view of the bag support of the present invention taken along line 7-7 of FIG. 4.

As described, first and second frames 112 and 114, respectively, are pivotable between an unfolded configuration, FIG. 3, for supporting a bag during filling and a folded configuration, FIG. 8, wherein the first and second frames 112 and 114, respectively, lie in generally parallel planes for storage and transport of the bag support 110. With bag support 110 in its unfolded configuration, first and second side frame members 124 and 126, respectively, of second frame 114 engage corresponding stops 140 and 154 extending from first and second side frame members 116 and 118, respectively, of first frame 112 such that stops 140 and 154 retain first and second frames 112 and 114, respectively, in their unfolded configuration, FIG. 3, and prevent second frame 114 from continuing to pivot with respect to first frame 112 on pivot pins 146 and 160.

Bag 162 is retained on bag support 110 by first and second bag mounts 164 and 166, respectively, operatively connected to upper frame members 120 and 128 of first and second frames 112 and 114, respectively. It is noted that first and second bag mounts 164 and 166, respectively, are identical in structure. As such, the description hereinafter of first bag mount 164 is understood to describe second bag mount 166, as if fully described herein.

First bag mount 164 includes bar 168 extending along a longitudinal axis and having first and second opposite ends 170 and 172, respectively. Bar 168 is generally parallel to and positioned below and laterally spaced from upper frame member 120 of first frame 112. First bag mount 164 includes a first mounting portion 174 that is generally parallel to bar 168 and is interconnected to upper frame member 120 of first frame 112. First mounting portion 174 is interconnected to bar 168 by a generally arcuate, concave portion 176. First bag mount 164 further includes a second mounting portion 180 generally parallel to central bar 168 and interconnected to upper frame member 120 of first frame 112. Second mounting portion 180 of first bag mount 164 is interconnected to bar 168 by a generally arcuate, concave portion 182. Bar 164, concave portions 176 and 182 and first and second mounting portions 174 and 180, respectively, of first bag mount 164 lie in a common plane and at an acute angle to supporting surface 11 with first and second frames 112 and 114, respectively, in their unfolded configuration, FIG. 3.

In operation, bag 162, preferably transparent, is provided. As is conventional, bag 162 includes a closed bottom end 184 and an opposite open end 186. Open end 186 of bag 162 includes opening 188 defined by upper peripheral edge 189. A first portion of the upper edge 189 of bag 162 is pulled over upper frame member 120 of first frame 112 and is wrapped around first bag mount 164 such that concave portions 176 and 182 of first bag mount 164 retains bag 162 thereon. A second portion of the upper edge 189 of bag 162 is pulled over upper frame member 120 of second frame 114 and is wrapped around second bag mount 166 such that concave portions 176 and 182 of second bag mount 166 retain bag 162 thereon. With bag 162 mounted on bag support 110, as heretofore described, opening 188 in bag 162 is directed upwardly between upper frame members 120 of first and second frames 114 and 116, respectively. Thereafter, bag support 110 is inserted into the chamber defined by recycle center 10 such that opening 188 in bag 162 is axially aligned with openings 76 through upper panel 72 of recycle center 10. As such, any items to be recycled that are deposited in opening 76 in upper panel 72 of recycle center 10 will be received within bag 162 through opening 188 therein. It can be appreciated that a plurality of rollers 191 may be rotatably mounted to lower frame members 122 and 130 of first and second frames 112 and 114, respectively, to facilitate the movement of bag support 110 into and out of the chamber defined by recycle center 10.

Figure 9:
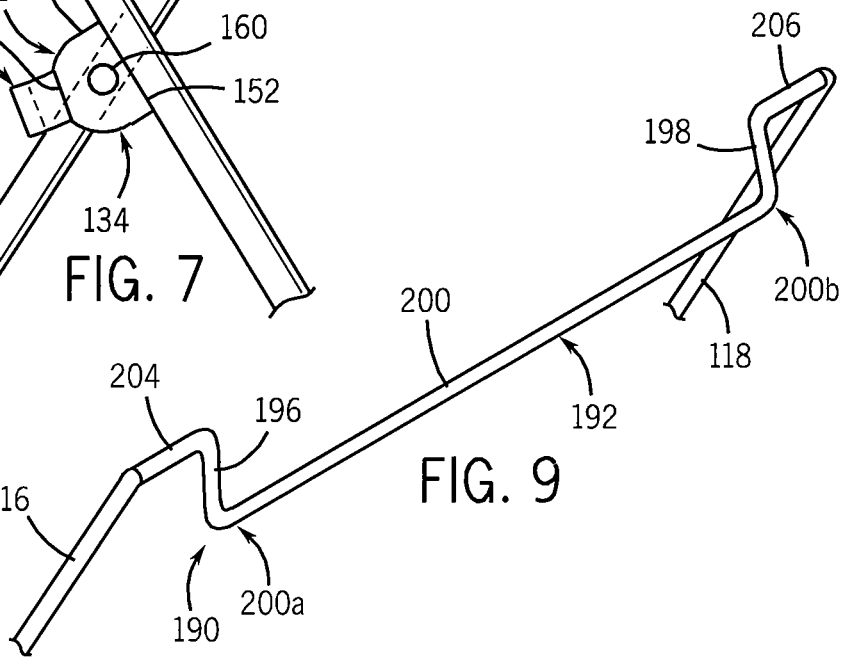
FIG. 9 is an isometric view of a portion of an alternate embodiment of a bag support in accordance with the present invention.

Referring to FIG. 9, it is contemplated to replace upper frame members 120 and 128 of first and second frames 112 and 114, respectively, as well as, first and second bag mounts 164 and 166, respectively, by an alternate bag mount, generally designated by the reference numeral 190. Bag mount 190 is defined by a generally U-shaped member 192 having first and second legs 196 and 198, respectively, interconnected by an elongated rod 200. Ends 200*a* and 200*b* of rod 200 are spaced from corresponding first and second side frame members 116 and 118, respectively, of first frame 112 or corresponding first and second side frame members 124 and 126, respectively, of second frame 114. The terminal end of first leg 196 of each bag mount 190 is interconnected to a corresponding first side frame member 116 and 124 of first and second frames 112 and 114, respectively, by connection rod 204. The terminal end of second leg 198 of each bag mount 190 is interconnected to a corresponding second side frame member 118 and 126 of first and second frames 112 and 114, respectively, by connection rod 206. U-shaped members 192, connection rods 204 and connection rods 206 lie in a common plane and at an acute angle to supporting surface 11 with first and second frames 112 and 114, respectively, in their unfolded configuration, FIG. 3.

In operation, a first portion of the upper edge 189 of bag 162 is pulled over connection rods 204 and 206 of first frame 112 and is wrapped around bag mount 190 such that legs 196 and 198 of U-shaped member 192 retain bag 162 thereon. A second portion of the upper edge 189 of bag 162 is pulled over connection rods 204 and 206 of second frame 114 and is wrapped around bag mount 190 such that legs 196 and 198 of U-shaped member 192 retain bag 162 thereon. With bag 162 mounted on bag support 110, as heretofore described, opening 188 in bag 162 is directed upwardly between upper bag mounts 190 of first and second frames 114 and 116, respectively. Thereafter, bag support 110 is inserted into the chamber defined by recycle center 10 such that opening 188 in bag 162 is axially aligned with openings 76 through upper panel 72 of recycle center 10.

Figure 11:
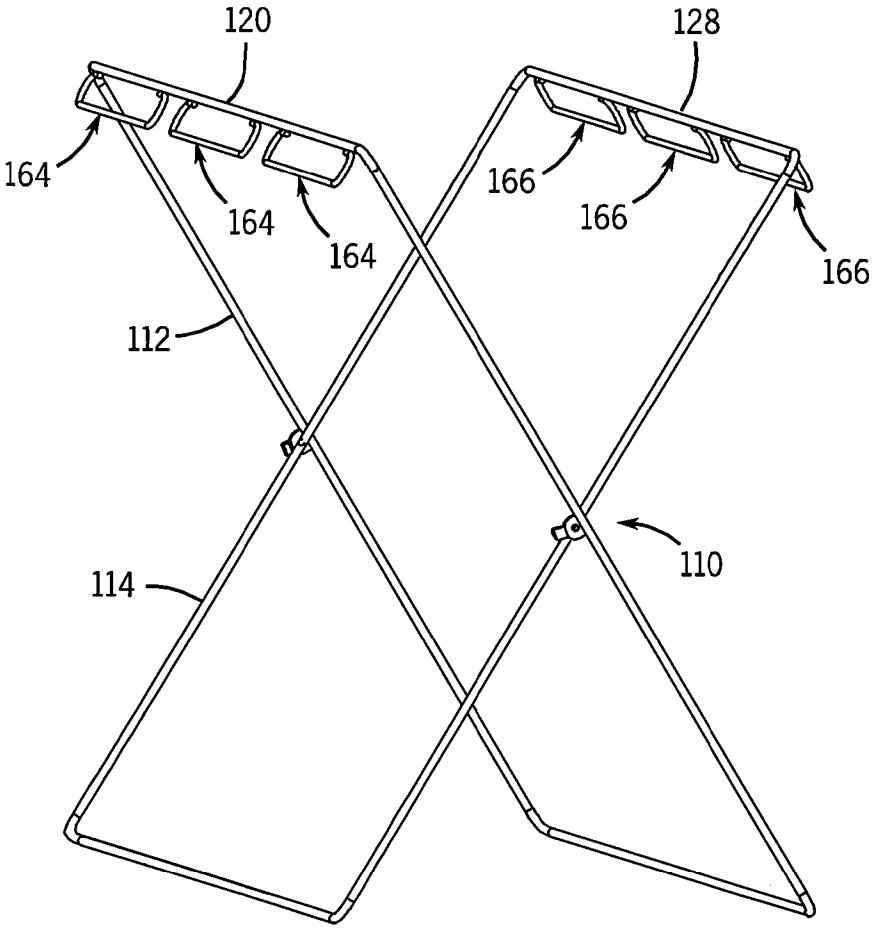
FIG. 11 is an isometric view of a portion of a third alternate embodiment of a bag support in accordance with the present invention.
Figure 10:
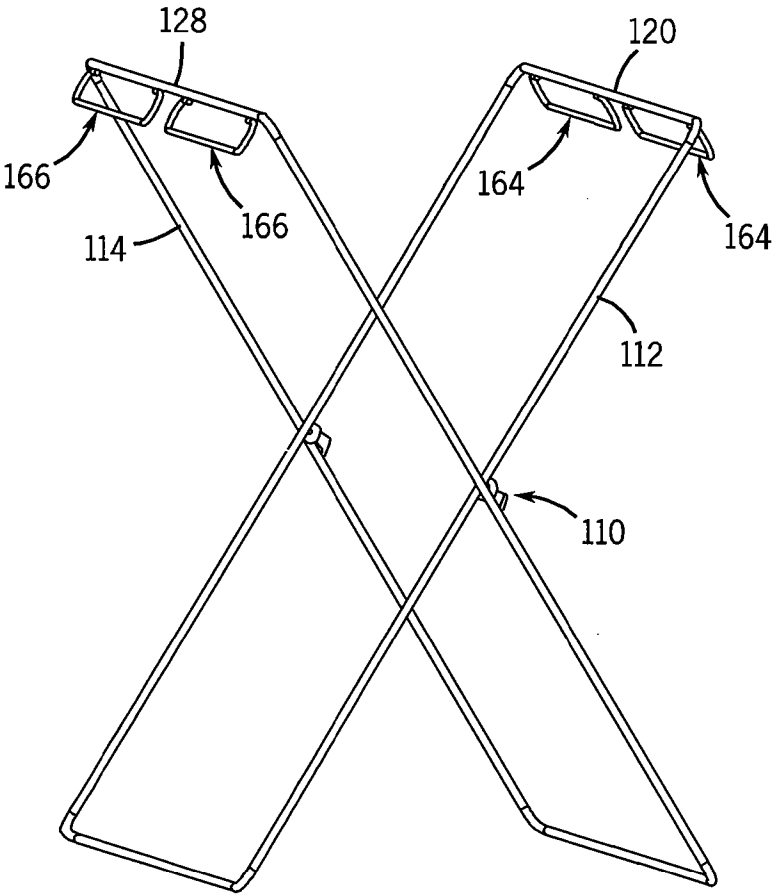
FIG. 10 is an isometric view of a portion of a second alternate embodiment of a bag support in accordance with the present invention.

Referring to FIGS. 10-11, it is contemplated to provide a plurality of first bag mounts 164 on upper frame member 120 of first frame 112 and an equal number of second bag mounts 166 on upper frame member 128 of second frame 114. By way of example, a pair of axially spaced first bag mounts 164 may be mounted upper frame member 120 of first frame 112 and an equal number of second bag mounts 166 on upper frame member 128 of second frame 114, FIG. 10. As a result, a pair of bags 162 may be supported on bag support 110 as heretofore described. Similarly, referring to FIG. 11, three axially spaced first bag mounts 164 may be provided upper frame member 120 of first frame 112 and an equal number of second bag mounts 166 may be provided on upper frame member 128 of second frame 114. As a result, three bags 162 may be supported on bag support 110 as heretofore described. It can be appreciated that additional bag mounts may be provided on upper frame members 120 and 128 of first and second frames 112 and 114, respectively, without deviating from the scope of the present invention.

Figure 12:
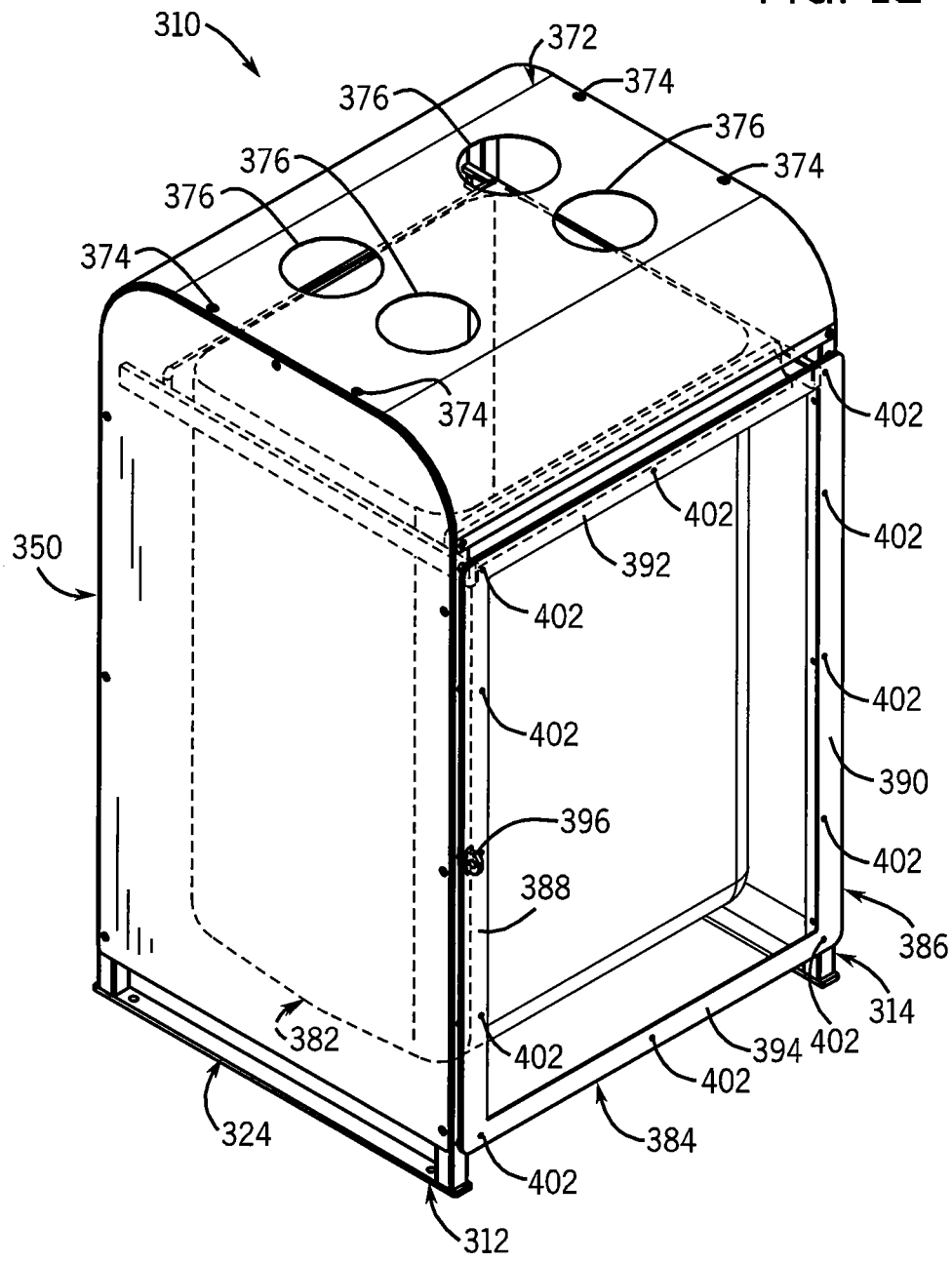
FIG. 12 is an isometric view of a recycling center incorporating a fourth alternate embodiment of a bag support/slide in accordance with the present invention.

Referring to FIG. 12, a recycling center incorporating an alternate bag support/slide in accordance with the present invention is generally designated by the reference numeral 310. As hereinafter described, it is intended for the recycling center 310 to be supported on a supporting surface 311 and to house a bag or the like for receiving recyclable materials therein. Recycling center 310 includes first and second generally U-shaped frame members 312 and 314, respectfully. It is noted that first and second frame members 312 and 314 are identical in structure. As such, the description hereinafter of first frame member 312 is understood to describe second frame member 314 as if fully described herein.

Figure 13:
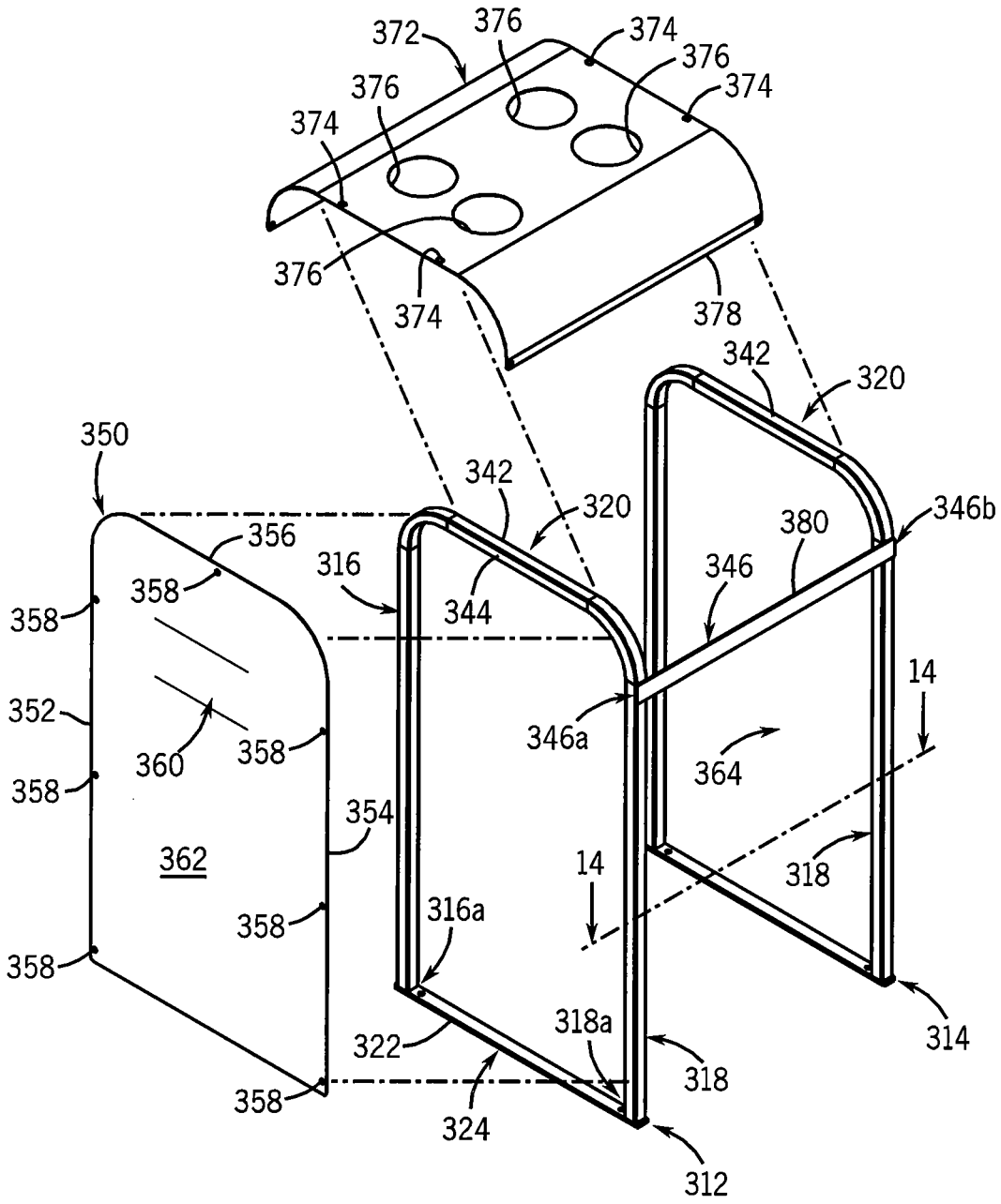
FIG. 13 is an exploded view of a portion of the recycling center of FIG. 12.
Figure 14:
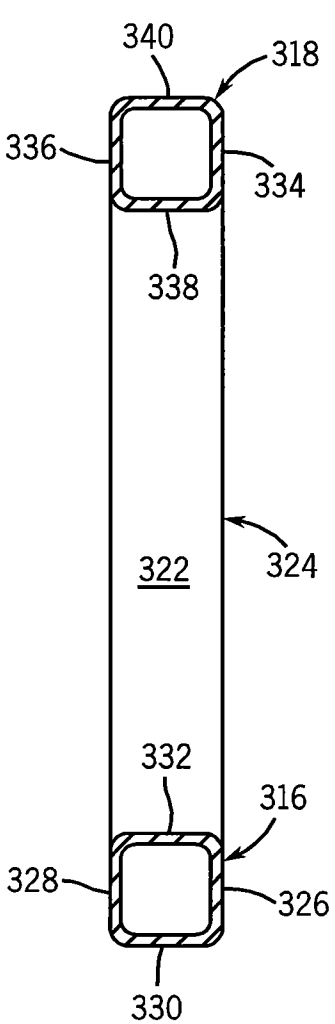
FIG. 14 is a cross-sectional view of the recycling center taken along line 14-14 of FIG. 13.
Figure 14:
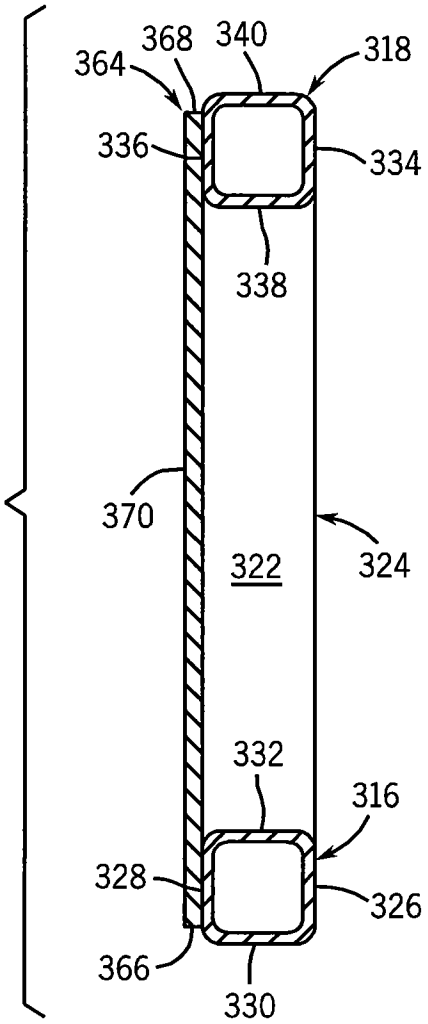

First frame member 312 is generally U-shaped and has a generally square cross section. As best seen in FIGS. 13 and 14, first frame member 312 is defined by first and second spaced legs 316 and 318, respectfully. Upper ends of first and second legs 316 and 318, respectfully, of first frame member 312 are interconnected by upper cross leg 320. First and second legs 316 and 318 terminate at generally flat lower ends 316*a* and 318*a*, respectfully. Lower ends 316*a* and 318*a* of first and second legs 316 and 318, respectfully, of first frame member 312 are positioned on and interconnected to upper surface 322 of generally flat lower frame member 324.

First leg 316 of first frame member 312 includes a generally parallel inner and outer faces 326 and 328, respectively, interconnected by generally parallel sides 330 and 332, respectfully. Second leg 318 of first frame member 312 also includes inner and outer faces 334 and 336, respectively. Outer face 336 of second leg 318 of first frame member 312 lies in a common plane with outer face 328 of first leg 316 of first frame member 312. Inner and outer faces 334 and 336, respectively, of second leg 318 of first frame member 312 are interconnected by first and second generally parallel, spaced sides 338 and 340, respectively. Sides 330 and 340 of first and second legs 316 and 318, respectively, of first frame member 312 are interconnected by upper surface 342 of upper cross leg 320. Outer faces 328 and 336 of first and second legs 316 and 318, respectively, of first frame member 312 are interconnected by generally flat outer face 344 of cross leg 320.

First and second frame members 312 and 314, respectively, are interconnected by forward cross frame support 346. Forward cross frame support 346 includes a first end 346*a* affixed to side 340 of second leg 318 of first frame member 312 and a second end 346*b* affixed to side 340 of second leg 318 of second frame member 314. It is further contemplated to interconnect first legs 316 of first and second frame members 312 and 314, respectively, to add strength and rigidity to recycling center 310.

First panel 350 is interconnected to outer faces 328 and 336 of first and second legs 316 and 318, respectively, of first frame member 312 and to outer face 344 of upper cross leg 320 of first frame member 312. First panel 350 includes a first edge 352 aligned with side 330 of first leg 316 of first frame member 312; a second edge 354 aligned with side 340 of second leg 318 of first frame member 312; and upper edge 356 aligned with upper face 342 of upper cross leg 320 of first frame member 312. It is contemplated to interconnect first panel 350 to first frame member 320 with a plurality of spaced fasteners 358 such as rivets, screws, bolts or the like. It is further contemplated to provide indicia 316 on outer surface 362 of first panel 350 so as to allow a user to identify recycling center 310, as desired.

Second panel 364 is attached to outer faces 328 and 336 of first and second legs 316 and 318, respectively, of second frame member 314 and to outer face 344 of upper cross leg 320 of second frame member 318 by a plurality of spaced fasteners 358. Edge 366 of second panel 364 is aligned with outer face 330 of first leg 316 of second frame member 318; edge 368 of panel 364 is aligned with side 340 of second leg 318 of second frame member 314; and the upper edge of panel 364 is aligned with upper face 342 of upper cross leg 320 of second frame member 314. Outer surface 370 of second panel 364 may include indicia (not shown) to allow a user to identify recycling center 310, as desired.

Recycling center 310 may also include an optional rear panel (not shown) interconnected to first legs 316 of first and second frame members 312 and 314, respectively. In addition, recycling center 310 includes an upper panel 372 positioned on and interconnected to upper faces 342 of upper cross legs 320 of first and second frame members 312 and 314, respectively, by a plurality of fasteners 374 such as screws, bolts, and/or rivets. A plurality of apertures 376 extend through upper panel 372, for reasons hereinafter described. With upper panel 372 positioned on first and second frame members 312 and 314, respectively, forward edge 378 of upper panel 376 is adjacent upper edge 380 of forward cross support 346. As hereinafter described, upper panel 372 and first and second side panels 350 and 364, respectively, define a chamber for receiving a conventional bag 382 therein.

Figure 15:
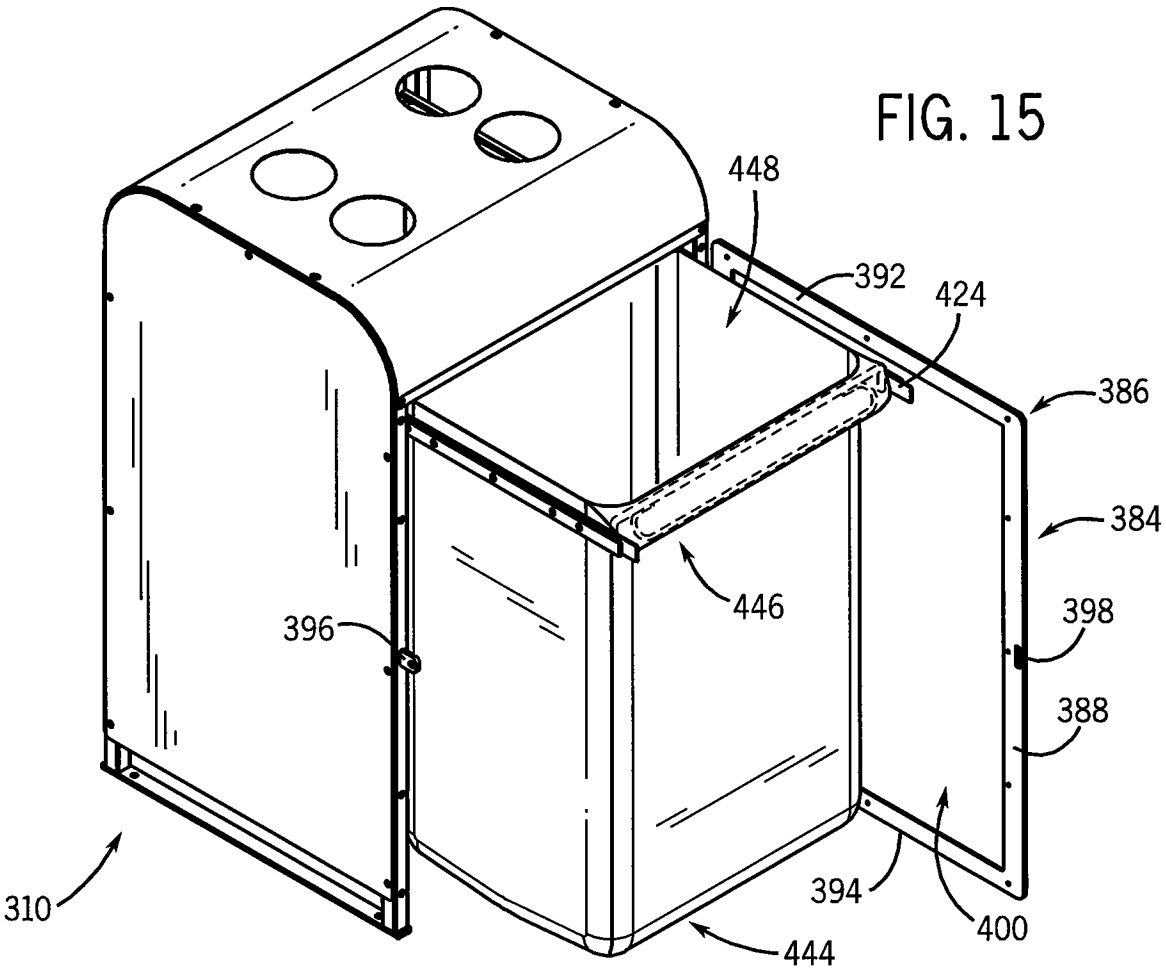
FIG. 15 is an isometric view of the recycling center of FIG. 12 with the door of the recycling center in the open position.
Figure 16:
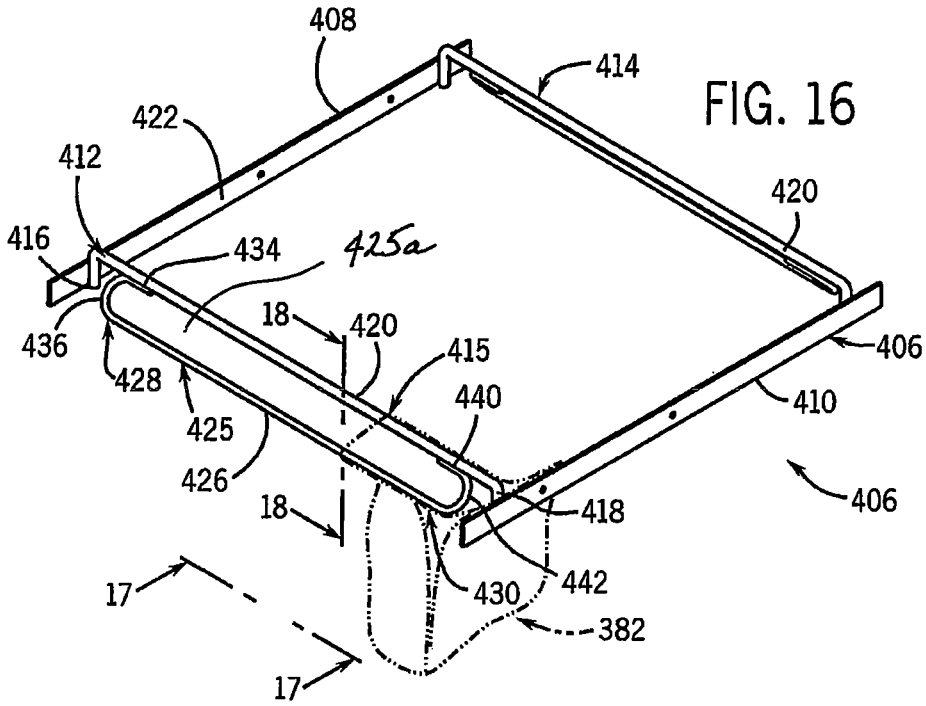
FIG. 16 is an isometric view of a bag holding slide of the bag support of the present invention.
Figure 18:
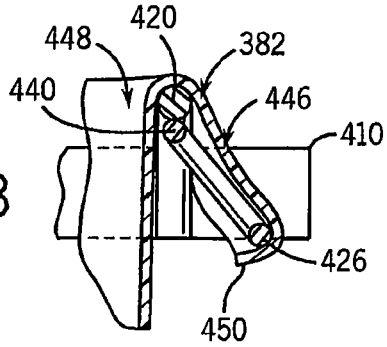
FIG. 18 is a cross-sectional view of the bag holding slide of the bag support of the present invention taken along line 5-5 of FIG. 3.
Figure 17:
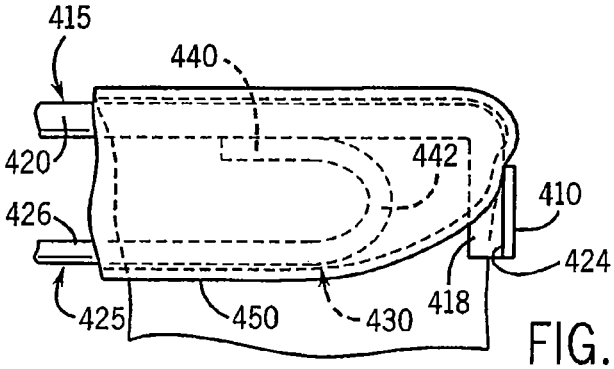
FIG. 17 is a cross-sectional view of the bag holding slide of the bag support of the present invention taken along line 4-4 of FIG. 3.

Recycling center 310 further includes door 384 to provide access to the chamber therein. Door 384 includes a generally rectangular frame 386 having first and second side elements 388 and 390, respectively, interconnected by upper and lower frame elements 392 and 394, respectively. Side frame element 390 of frame 386 is interconnected to side 340 of second leg 318 of second frame member 314 by one or more hinges so as to allow door 384 to pivot between a closed position, FIG. 12, and an open position, FIG. 15. In order to maintain door 384 in a closed position, locking eye 396 may project from side 340 of second leg 318 of first frame element 312. Locking eye 396 is aligned with a corresponding slot 398 in side frame element 388 of frame 386 of door 384 such that with door 384 in the closed position, locking eye 396 projects through slot 398 in frame 386 of door 384. A locking bar of a conventional pad lock may be inserted through the eye of locking eye 396 to retain door 384 in its closed position.

Figure 19:
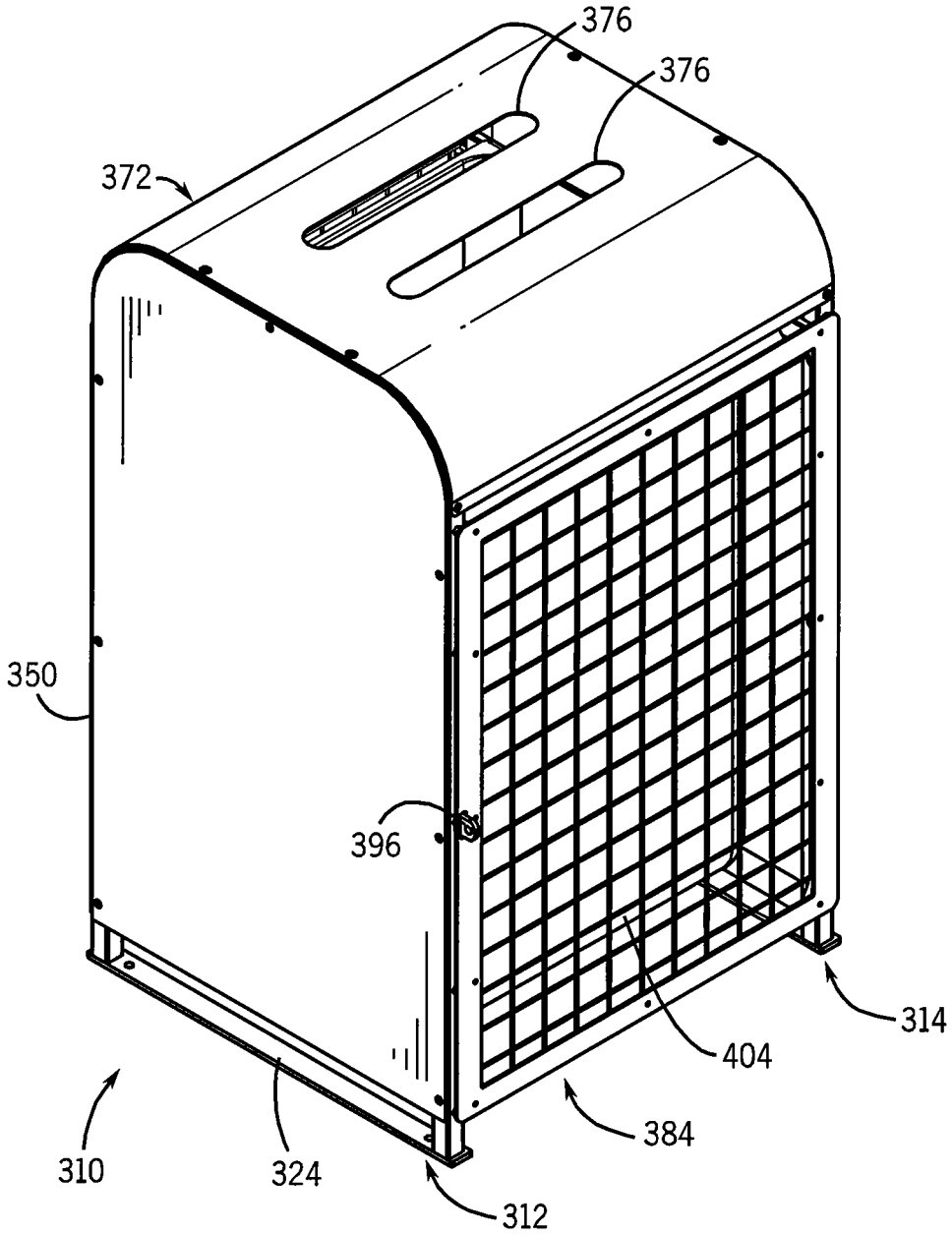
FIG. 19 is an isometric view of an alternate embodiment of a recycling center.

Panel 400 may be positioned within the opening defined by frame 386 and interconnected to frame 386 and retained therein by a plurality of fasteners 402. It is intended for panel 400 to be transparent in order to allow the quick and easy inspection of the chamber defined by the interior of recycling center 310. Alternatively, as best seen in FIG. 19, it is contemplated to provide wire mesh 404 within the interior of frame 386 of door 384 so as to allow easy inspection of the interior of recycling center 310.

Referring to FIGS. 15-18, bag 382 is supported by bag slide 406. Bag slide 406 includes first and second side rails 408 and 410, respectively. First side rail 408 is telescopically and slidably received within a support bracket (not shown) mounted to inner faces 326 and 334 of first and second legs 316 and 318, respectively, of first frame member 312 adjacent the upper ends of first and second legs 316 and 318, respectively. Second side rail 410 is telescopically and slidably received within a support bracket (not shown) mounted to inner faces 326 and 334 of first and second legs 316 and 318, respectively, of second frame member 318 adjacent the upper ends of first and second legs 316 and 318, respectively. First and second slide rails 408 and 410, respectively, and hence bag slide 406, is movable between a retracted position, FIG. 12, wherein bag slide 406 is received entirely within the interior of the chamber defined by recycling center 310 and an extended position, FIG. 15, wherein bag slide 106 projects from the chamber within recycling center 310.

First and second side rails 408 and 410, respectively, are interconnected by a forward bag support 412 and a rear bag support 414. It is noted that forward and rear bag supports 412 and 414, respectively, are identical in structure. As such, the description hereinafter of forward bag support 412 is understood to describe rear bag support 414 as if fully described herein.

Forward bag support 412 includes a generally U-shaped member 415 having first and second legs 416 and 418, respectively, interconnected by an elongated rod 420 that spaces first and second side rails 408 and 410, respectfully. First leg 416 of member 415 is affixed to inner surface 422 of first side rail 408. Second leg 418 of member 415 is interconnected to inner surface 424 of second side rail 410. Forward bag support 412 further includes a bag retainer 425. Bag retainer 425 includes bar 426 extending along a longitudinal axis and having first and second opposite ends 428 and 430, respectively. Bar 426 is generally parallel to and positioned below and laterally spaced from rod 420. The spacing of the bar 426 from rod 420 forms an opening 425*a*. Bag retainer 425 includes a first mounting portion 434 that is generally parallel to bar 426 and is interconnected to rod 420. First mounting portion 434 is interconnected to bar 426 by a generally arcuate, concave portion 436. Bag retainer 425 further includes a second mounting portion 440 generally parallel to central bar 432 and interconnected to rod 420. Second mounting portion 440 of bag retainer 425 is interconnected to bar 426 by a generally arcuate, concave portion 442. Bar 426, concave portions 436 and 442 and first and second mounting portions 434 and 440, respectively, of bag retainer 425 lie in a common plane and at an acute angle to supporting surface 311.

In operation, bag 382, preferably transparent, is provided. As is conventional, bag 396 includes a closed bottom end 444 and an opposite open end 446. Open end 446 of bag 382 includes opening 448 defined by upper peripheral edge 450. A first portion of the upper edge 450 of bag 382 is pulled over rod 420 of forward bag support 412 and is wrapped around bag retainer 425 of forward bag support 412 such that concave portions 436 and 442 of bag retainer 425 retains bag 382 thereon. A second portion of the upper edge 450 of bag 382 is pulled over rod 420 of rear bag support 414 and is wrapped around bag retainer 425 of rear bag support 414 such that concave portions 436 and 442 of bag retainer 425 retains bag 382 thereon. With bag 382 mounted on forward bag support 412 and rear bag support 414, opening 448 in bag 382 is directed upwardly between first and second side rails 408 and 410, respectively, of bag slide 406. Thereafter, bag slide 406 is slid towards its retracted position such that opening 448 in bag 382 is axially aligned with openings 376 through upper panel 372 of recycling center 310. As such, any items to be recycled that are deposited in opening 376 in upper panel 372 of recycling center 310 will be received within bag 382 through opening 448 therein.

Figure 20:
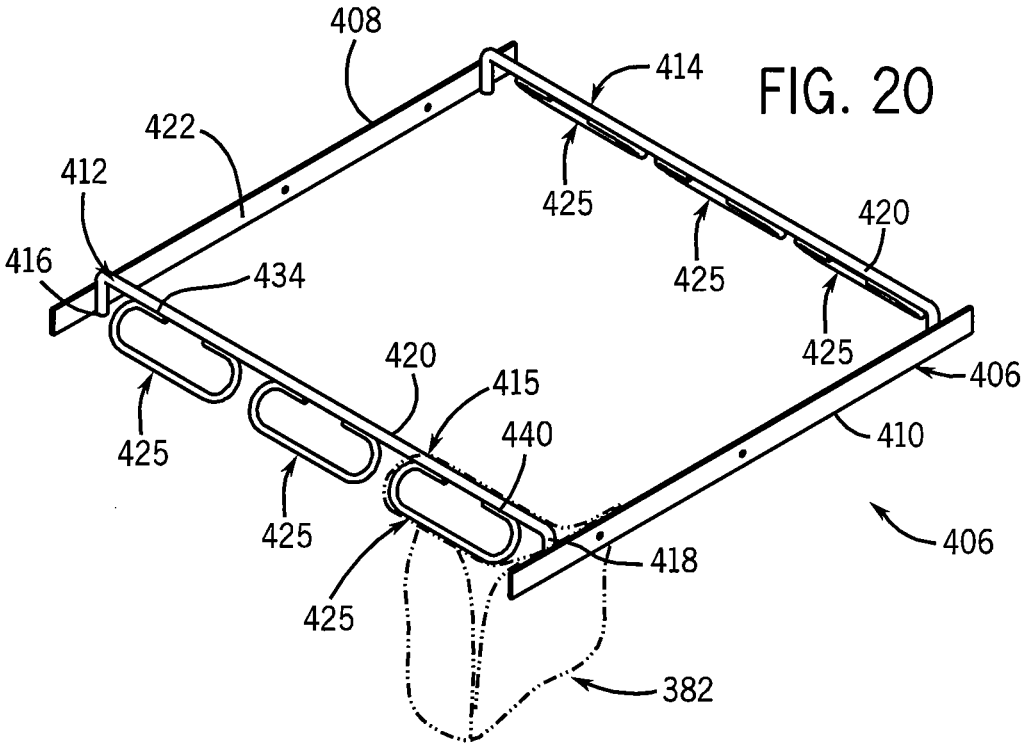
FIG. 20 is an isometric view of a portion of a fifth alternate embodiment of a bag support in accordance with the present invention.

It can be appreciated due to the modular nature of the present design, multiple recycling centers may be positioned adjacent one another and interconnected. Further, it can be appreciated that the openings 376 in upper panel 372 of recycling center 310 may have any desired configuration. By way of example, referring to FIG. 19, openings 376 in upper panel 372 of recycling center 310 may take the form of elongated slots adapted for receiving sheets of paper therethrough. Referring to FIG. 20, it is contemplated for forward bag support 412 and rear bag support 414 to include multiple bag retainers 425 axially spaced along rods 420 thereof so as to allow multiple bags to be mounted on bag slide 406. Finally, it can be appreciated that first and second side panels 350 and 364 may be fabricated from a solid material, a mesh material or a transparent material. It can be appreciated that by fabricating first and second side panels 350 and 364 from a transparent or mesh material will allow for the simple and easy inspection of the interior of recycling center 310.

Various modes of carrying out the invention are contemplated as being within the scope of the following claims particularly pointing out and distinctly claiming the subject matter which is regarded as the invention.

The invention claimed is:

1. A bag support for supporting the upper portion of a bag, comprising:

first and second side rails generally parallel to each other;

a first bag support rod extending between the first and second rails along a first axis, the first bag support rod including a first bag retainer extending therefrom;

a second bag support rod extending between the first and second rails along a second axis generally parallel to the first axis, the second bag support rod including a second bag retainer extending therefrom, wherein the first bag support rod and the second bag support rod, define an opening therebetween and wherein the bag is insertable through the opening and wherein the first and the second bag retainers are configured to each define a loop having first and second opposite ends overlapped by respective opposed ends of an upper portion of the bag when the bag is inserted through the opening so as to attach the bag to the bag support.

2. The bag support of claim 1 wherein the first bag retainer extending from the first bag support rod is one of a plurality of bag retainers extending from the first bag support rod.

3. The bag support of claim 2 wherein the plurality of bag retainers extending from the first bag support rod lie in a common plane.

4. The bag support of claim 2 wherein the first bag retainer extending from the second bag support rod is one of a plurality of bag retainers extending from the second bag support rod.

5. The bag support of claim 4 wherein the plurality of bag retainers extending from the second bag support rod lie in a common plane.

6. A bag support for supporting the upper portion of a bag, comprising:

first and second side rails generally parallel to each other;

a first bag support rod extending between the first and second rails along a first axis, the first bag support rod including a first bag retainer extending therefrom; and a second bag support rod extending between the first and second rails along a second axis generally parallel to the first axis, the second bag support rod including a first bag retainer extending therefrom, wherein the first bag retainer extending from the first bag support rod has first and second ends, the first end of the first bag retainer extending from the first bag support rod being generally C-shaped and the second end of the first bag retainer extending from the first bag support rod being generally C-shaped.

7. The bag support of claim 6 wherein the first bag retainer extending from the second bag support rod has first and second ends, the first end of the first bag retainer extending from the second bag support rod being generally C-shaped and the second end of the first bag retainer extending from the second bag support rod being generally C-shaped.

8. The bag support of claim 1 wherein:

the first and second rails include forward and rear ends;

the first bag support rod extends between the rear ends of the first and second rails; and the second bag support bar extends between the forward ends of the first and second rails.

9. A bag support, comprising:

a first bar extending along a first axis and including a first bag retainer extending therefrom, the first bag retainer supporting an upper portion of a corresponding bag;

a second bar extending along a second axis generally parallel to the first axis and including a first bag retainer extending therefrom, the first bag retainer of the second bar supporting the upper portion of the corresponding bag; and a first support member extending along a third axis and having a first end operatively connected to the first bar and a second end operatively connected to the second bar, wherein the first bag retainer extending from the first bar has first and second ends, the first end of the first bag retainer extending from the first bar being generally C-shaped and the second end of the first bag retainer extending from the first bar being generally C-shaped.

10. The bag support of claim 9 wherein the first bag retainer extending from the first bar is one of a plurality of bag retainers extending from the first bar.

11. The bag support of claim 10 wherein the plurality of bag retainers extending from the first bar lie in a common plane.

12. The bag support of claim 11 wherein the first bag retainer extending from the second bar is one of a plurality of bag retainers extending from the second bar.

13. The bag support of claim 12 wherein the plurality of bag retainers extending from the second bar lie in a common plane.

14. The bag support of claim 9 wherein the first bag retainer extending from the second bar has first and second ends, the first end of the first bag retainer extending from the second bar being generally C-shaped and the second end of the first bag retainer extending from the second bar being generally C-shaped.

15. A bag support, comprising:

a first bar extending along a first axis;

a second bar extending along a second axis generally parallel to the first axis;

a first support having a first end operatively connected to the first bar and a second end operatively connected to the second bar;

a first bag retainer extending from the first bar, the first bag retainer having first and second ends; and a second bag retainer extending from the second bar, the second bag retainer having first and second ends, wherein the first end of the first bag retainer is generally C-shaped and the second end of the first retainer is generally C-shaped.

16. The bag support of claim 15 wherein the first end of the second bag retainer is generally C-shaped and the second end of the second bag retainer is generally C-shaped.

17. The bag support of claim 15 wherein the first bag retainer extending from the first bar is one of a plurality of bag retainers extending from the first bar.

18. The bag support of claim 17 wherein the second bag retainer extending from the second bar is one of a plurality of bag retainers extending from the second bar.

* * * * *